US006817129B1

(12) United States Patent
Purdy et al.

(10) Patent No.: US 6,817,129 B1
(45) Date of Patent: Nov. 16, 2004

(54) DISPLAY KIT FOR MEDALLION WITH RIBBON

(75) Inventors: Craig Purdy, 3444 Wine Cork Way, San Jose, CA (US) 95124; Christine Marquez, 3444 Wine Cork Way, San Jose, CA (US) 95124; Mike Torsky, 34752 Clover St., Union City, CA (US) 94587

(73) Assignees: Craig Purdy, Brentwood, CA (US); Christine Marquez, Brentwood, CA (US); Mike Torsky, Union City, CA (US)

( * ) Notice: Subject to any disclaimer, the term of this patent is extended or adjusted under 35 U.S.C. 154(b) by 24 days.

(21) Appl. No.: 10/449,473

(22) Filed: Jun. 2, 2003

(51) Int. Cl.[7] ..... A47G 1/06

(52) U.S. Cl. ..... 40/800; 40/722; 40/746; 40/748; 40/757; 428/913.3

(58) Field of Search ..... 40/800, 722, 746, 40/748, 757; 428/913.3

(56) References Cited

U.S. PATENT DOCUMENTS

| | | | | | |
|---|---|---|---|---|---|
| D159,940 | S | | 8/1950 | Vanderput | |
| 4,125,655 | A | | 11/1978 | Kanzelberger | |
| 4,161,831 | A | * | 7/1979 | Restle | 40/800 |
| 4,190,691 | A | | 2/1980 | Kramer | |
| D260,208 | S | | 8/1981 | Nutting | |
| 4,655,428 | A | * | 4/1987 | McCrea | 40/746 |
| 5,015,532 | A | | 5/1991 | Knight | |
| D359,255 | S | | 6/1995 | Williams | |
| 5,424,137 | A | | 6/1995 | Stagl | |
| 5,472,765 | A | | 12/1995 | Green | |
| 5,524,370 | A | | 6/1996 | Roy | |
| 5,853,823 | A | | 12/1998 | McKenna | |
| 5,960,573 | A | | 10/1999 | Wong | |
| D426,999 | S | | 6/2000 | Smith | |
| 6,226,850 | B1 | * | 5/2001 | Parini | 40/800 |
| D446,745 | S | | 8/2001 | Richardson | |
| 6,282,827 | B1 | | 9/2001 | Holmes | |
| 6,434,873 | B1 | | 8/2002 | Pierce | |
| 2002/0108287 | A1 | * | 8/2002 | Tran | 40/800 |
| 2002/0145365 | A1 | | 10/2002 | Johnson | |

FOREIGN PATENT DOCUMENTS

| | | |
|---|---|---|
| FR | WO 00/47090 | 8/2000 |

* cited by examiner

*Primary Examiner*—Gary C. Hoge

(57) ABSTRACT

A kit is provided for a pendant like award that assembles into an attractive display. It comprises the plaque-like member having peripheral edges on the front side with decorative materials, adhesives, and a location for event information, a predetermined cavity on back side having a counter bore rim with sides and bottom edge, a clearance cut on the top interior edge of the cavity and a fastener hole near each corner. A felt pad is positioned near each backside corner of the plaque-like member to protect other surfaces. Also a predetermined cover plate having a notch for means of either affixation to a wall surface, or used as an attachment of a leg for free standing. Fasteners are positioned through counter sunk holes in the cover plate into the plaque-like member in order to attach the cover plate. Once assembled, the invention provides a specific space where the ribbon can be stored. A portion of the ribbon is displayed on the front with the selected medallion highlighted in a three-dimensional setting, and a location for an engraved placard or engraved information onto plaque-like surface.

3 Claims, 3 Drawing Sheets

DISPLAY KIT FOR MEDALLION WITH RIBBON

BACKGROUND OF INVENTION

1. Field of the Invention

The present invention relates to a display kit for medallion with a ribbon. The medallion with ribbon can be considered a pendant style achievement award that is placed around the neck of the recipient for such sports as running swimming, gymnastics, etc. In particular, the invention is for the purpose of providing a display kit for a medallion with a ribbon. The unique design includes a plaque or plaque-like member with a cavity in the back to conceal the ribbon when a cover plate is fastened. Once assembled the invention can hang on a vertical wall, or stand on a flat surface. Also, the display provides an attractive three-dimensional presentation of the award. A number of kits can be displayed side-by-side on a wall, where any design configuration of numerous medallion with ribbon kits can be displayed. An additional alternative is to display the invention next to a personalized photograph of the event. The invention encompasses an apparatus and assembly.

2. Background of the Invention

There is a need to have a three dimensional display for a selected medallion with a ribbon where the ribbon, or other necklace-like material, is concealed in a cavity of a plaque or plaque-like member with a notch for easy hanging or free standing, is easy-to-assemble, and which can be manufactured easily for a mass market. This display provides individual appeal and desirability to individuals who want to view their award medallion with a ribbon, whether as a wall hanging, or a freestanding display. This display is an excellent alternative to the current ways of displaying medallions with ribbons. It is superior to hanging the medallion with a ribbon on a rack, placing it in a box or a plastic case. The ribbon concealed out of the way in the cavity of a plaque or plaque-like member, the front side can be used to highlight the award through the use of colored shaped materials. Selecting custom plaque front colors and colored material shapes gives numerous options to create a custom look when more than one medallion and ribbon display are hung side by side.

This display can be used for pendants, or any necklace-type items as well.

Currently mass-produced is a framed box, generally called a "Shadow Box" or display box, for displaying one or more award medallions with ribbons. The award is placed behind glass or plastic where it can be displayed with other items. Another display method is one where one or more medallions are placed on plaques with the ribbon cut, removed, or held by a retainer.

The present invention is directed to improving a plaque specifically for displaying a medallion with a ribbon. It provides a specific place where the ribbon can be stored out of the way, along with a portion of the ribbon displayed on the front with the medallion. The display kit is safe, easy-to-assemble, has display mode versatility, wall hanging or freestanding, and is aesthetically pleasing. It can be economically manufactured for mass market.

3. Description of the Prior Art

The use of wall mounting kits are known in displaying diversified achievements, which range any where from taxidermy to commemorative or artifact plaques with a special memento or medallion and an engraved plate attached to the front. Boxes with glass panels are also used to display achievements or collections. Some display kits are wall mounted or stand alone such as paper certificates or photos in a frame. Others are medallion holders, which look like trophies or have a multiple display rack.

For example, U.S. Pat. No. Des 159,940 to Vanderput (1950) shows a souvenir plaque, U.S. Pat. No. Des 260,748 to Buschmann shows the ornamental design for an artifact plaque, and U.S. Pat. No. Des 359,255 to Williams (1994) shows the ornamental design for a commemorative plaque. While the present invention may have these designs, these patents do not have a functional cavity for the ribbon to remain attached and concealed while displaying the medallion.

U.S. Pat. No. 5,277,949 to Green (1995) shows frame with glass on both sides for athletic miniatures and sports memorabilia. European Patent No. WO0047090 to Pierre shows a display case for a flat object medal.

U.S. Pat. No. 5,424,137 to Stagl (1995) shows a trophy comprising of a sportsball riser with medallion holder. The mounting means for a medallion is located outside the sphere with the first portion being retained in the slot.

U.S. Pat. No. Des 426, 999 to Smith (2000) shows trophy and medallion display shelf where the medallions with ribbons can be displayed on the triangle shape pieced attached to edge of the shelf. The ribbon goes over the triangle shape and hangs down from the shelf.

US2002145365 to Johnson (2002) shows a practical framed showcase for medals, pendant type awards, where the medal and a part of the ribbon remain visible from the front of the display panel. Retainers are attached to the rear surface of the display to secure the excess length of ribbon out of view, and to hold the medal suspended in place on the front side of the display.

Disadvantages of some of the current plaques include that the ribbon is removed completely displaying only the medallion, medal or artifact. Or the ribbon is cut and only a portion remains and is displayed with the medallion. In other instances the medallion and ribbon are enclosed in a protective case or hung from a shelf. The showcase for medals is at a disadvantage as a large format. A large wall area is needed to display the showcase, and the ribbon has to be secured in rear with retainers.

In this respect, the display kit for medallion with a ribbon according to the present invention departs from the conventional design and display of the prior art, and in so doing provides an apparatus primarily developed for the purpose of displaying a medallion with a ribbon. The distinguishing feature of this design is a cavity in the back of the plaque or plaque like member where the ribbon can be concealed out of the way. This unique feature allows the ribbon to be folded away while leaving a small portion of it attached to the medallion in front. A cover plate fits over the ribbon, enclosing it in the cavity, and leaving a smooth surface on the back of the plaque. This gives a sleek, finished look and allows the invention to be placed on the wall or used as a stand-alone display. The invention also has three-dimensional visual appeal for a uniformed or custom look once assembled.

The present invention is an improvement of prior art mentioned and incorporates it into a useful display kit for a medallion with a ribbon. The distinctive cavity is for storing the ribbon in an orderly fashion, ensuring a compact, attractive display. Unlike with other display models the ribbon does not have to be removed, hung loose, or fastened down with special retainers.

SUMMARY OF INVENTION

The primary objective of the display kit for medallion with a ribbon is an easy-to-assemble wall or stand-alone display, for a medallion with ribbon by concealing the ribbon or necklace-like material in a cavity in the rear. This enables one to display the medallion, complete with ribbon, in a compact, attractive setting. Cost can vary with standard or customize selections. This invention can be economically manufactured for a mass market.

Another objective of the display kit for medallion with a ribbon is to improve the aesthetic view of the medallion with a ribbon. This is achieved in various ways. The medallion with a ribbon when placed on different shaped materials can provide three-dimensional appeal. The display is a convenient size as a wall hanging or free standing for space efficiency. It can be displayed with more than one kit at a time, in various design configurations, or it can be displayed next to a photograph. Also, optional color choices for components provide personal preference of aesthetics for viewing the medallion with its' ribbon.

BRIEF DESCRIPTION OF DRAWINGS

Specific embodiments of the invention and other objects and advantages included in the invention will be apparent from the following description taken in connection with the accompanying illustrations, in which.

DETAILED DESCRIPTION OF DRAWINGS

Figure 1:
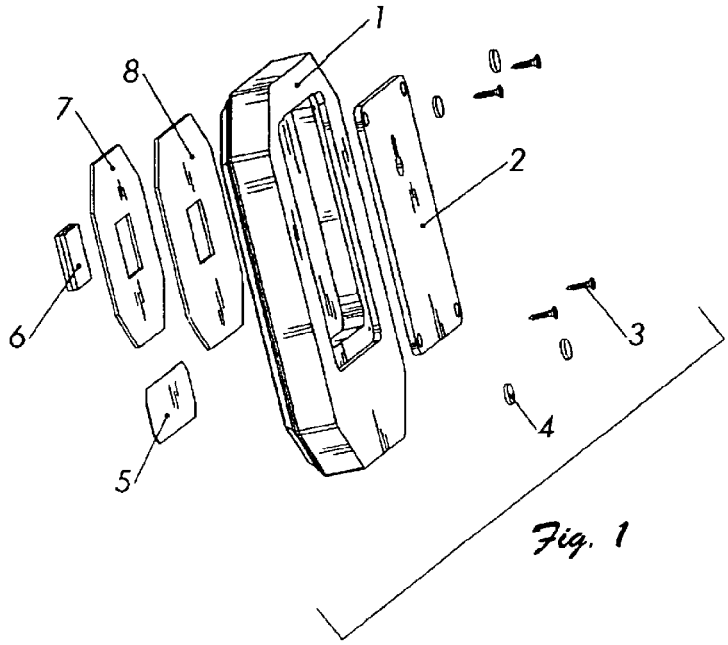
FIG. 1 is an exploded elevation rear view of first embodiment of the display kit for medallion with ribbon showing the disposition of various visible components and assembly thereof present invention.

FIG. 1 illustrates a display kit for medallion with ribbon and assembly in accordance with the teachings of the present invention. With reference to FIG. 1 as well as the other figures of the drawings, the kit is comprised of 1 a plaque or plaque-like member having peripheral edges, a backside having a predetermined cavity that defines a space for the ribbon. The predetermined cavity has a counter bore, creating a rim on sides and bottom edge with a clearance cut on top interior edge of cavity. Also a predetermined cover plate 2 with round corners, including a notch located in the middleupper part of cover plate for a means of hanging on a vertical wall, and pre-drilled fastening holes near each round corner. Referencing now the pre-drilled fastening holes near each round corner, fastening means suitable wood screws 3, placed and aligned with fastening holes in cover plate 2. The cover plate and the plaque or plaque-like members are held together by fastening means; one fastening hole in each corner of cover plate 2. The cavity 13 is formed when the plaque or plaque-like member and cover plate are placed together when said the display for medallion with a ribbon is assembled. Soft material 4 placed on backside of the plaque or plaque-like member near corners to protect backside from touching other surfaces. On the front side of the plaque-like member 1 has adhesive material 6 and shaped material 7, 8. Shaped material 7 is smaller in size than shaped material 8 so 8 creates a boarder around 7. The plaque or plaque-lie member front has engraved information displayed toward the bottom of front panel on the surface of the plaque or plaque-like member or on placard 5.

Figure 2:
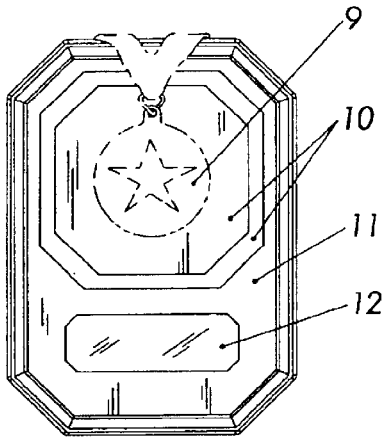
FIG. 2 is a front view of the display for medallion with ribbon according to the present invention.

FIG. 2 illustrates the front view of the display for the medallion with a ribbon shown assembled, where 9 is the supplied medallion placed on top of the adhesive material 6. The adhesive material fits into the cut outs in the shaped materials 10 to adhere the medallion to the plaque-like member 11. A spray mount adhesive can be used on the backside of the shaped materials 10 to adhere the materials to the front of the plaque or plaque-like member 11. The plaque-like member means; plaque; wood, or material processed to look like wood including injection molding, plaster, paper, as well as any other decorative medium. If wood, the plaque-like member can be color stained and/or color varnished or varathane coated. 12 illustrates information placement toward bottom of front panel in forms such as engraved lettering onto the surface material of the plaque, or onto other material including, but not limited to polished brass, bright aluminum, acrylic opaque material, etc.

Figure 3:
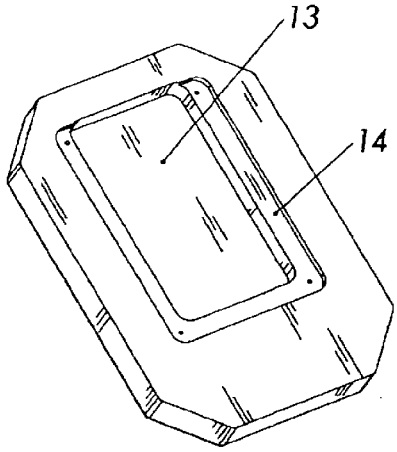
FIG. 3 is a rear perspective view of the display for medallion with ribbon showing the cavity according to the present invention.

The cavity 13, hollow space, for ribbon is shown in FIG. 3, and has a counter bore rim on the sides and the bottom edge 14. A small fastener hole near each corner on the counter bore rim 14 is for easy positioning the cover plate and fastening it once the ribbon is placed in the cavity.

Figure 4:
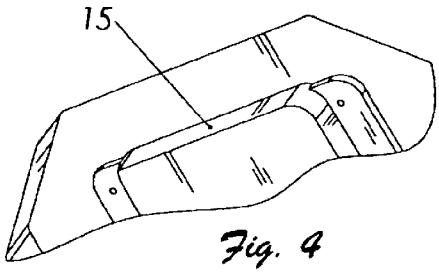
FIG. 4 is the partial rear perspective view of the display for medallion with ribbon showing thin clearance cut on the top interior edge of the cavity, a gap, for the ribbon according to the present invention.

FIG. 4 illustrates the thin clearance cut on the top interior edge of the cavity 15. It is for the ribbon to wrap into the cavity as the cover plate is fastened.

Figure 5:
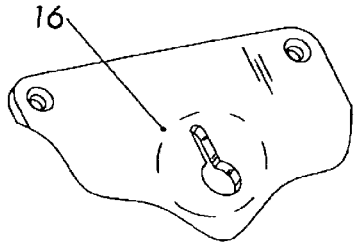
FIG. 5 is the notch on the cover plate for receipt of mean wall hanging, or freestanding mode according to the present invention.

FIG. 5 illustrates the notch located in the middle-upper part of the cover plate 16. It is a means of hanging the display on a vertical wall, or an attachment for free standing mode.

Figure 6:
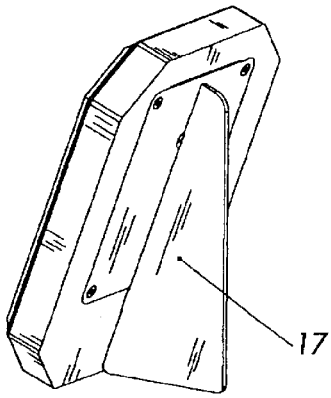
FIGS. 6, 6B, 6C is a rear perspective view of the second embodiment of the display kit for medallion with ribbon according to present invention.
Figure 6A:
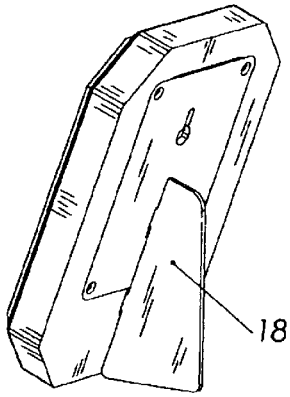
FIG. 6A is a rear perspective view of the display for medallion with ribbon showing an optional table leg size and placement.
Figure 6B:
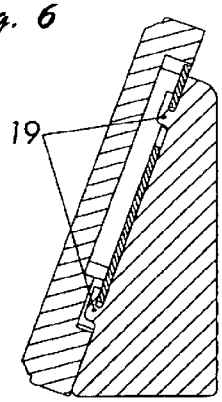
Figure 6C:
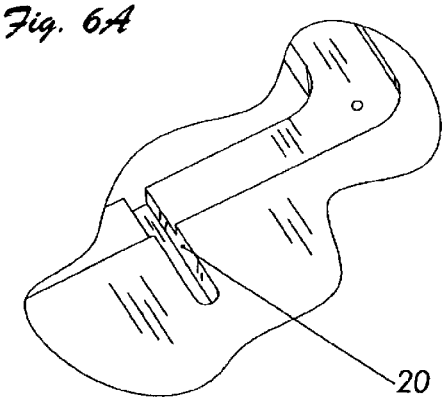

FIGS. 6, 6B, 6C shows a table leg 17 with two attachment hooks 19 that fit into the notch in the cover plate and a pre-determined vertical guide groove 20 at base of the cavity. The leg aligns with a notch in the cover plate for free standing mode.

Figure 7:
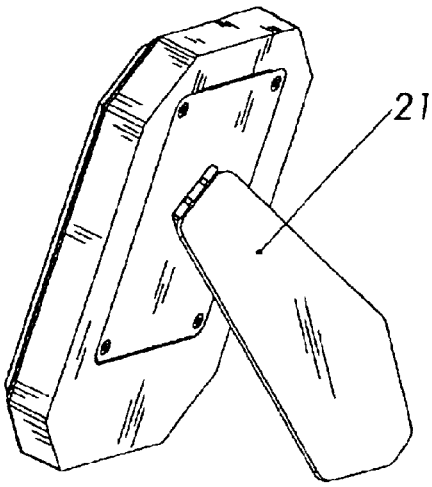
FIG. 7 is a rear perspective view of the display for medallion with ribbon showing an optional table leg attachment to the cover plate for freestanding mode.

An optional table leg attachment to the cover plate for free standing 21 is shown in FIG. 7.

Figure 8:
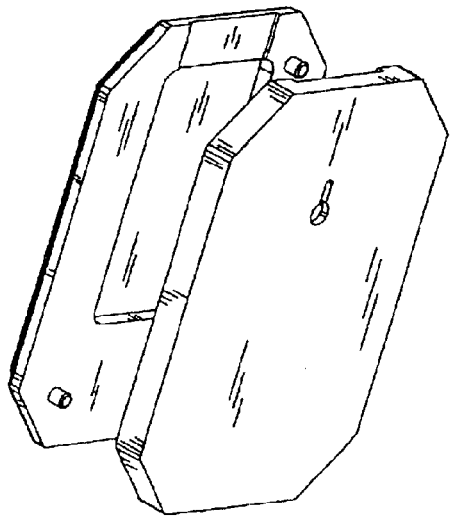
FIG. 8 is a rear perspective view of an option plaque-like member where cavity is between to surfaces instead on backside of one surface.

FIG. 8 is an option plaque or plaque-like member to 1 where cavity is between to surfaces instead of on the backside of one surface. This would not be the ideal embodiment since more work would be involved in producing this option.

Assembly starts on the front panel. Determine if one shaped material 7 or two shaped materials 7 and 8 will be used. This may be based on the size and shape of the medallion and how much ribbon is to show. If 7 and 8 are used, 7 is smaller in size than 8 material so 8 creates a boarder around 7 material depicted in FIG. 2. Pre-measure and center position the shaped materials with a cut out in the center of the materials on the top two-thirds portion of plaque front. Adhere shaped materials to plaque-like member front with spray adhesive on backside of shaped material if so desired. The size of the cut out in center of the material 7 and 8 depends on the size of the medallion. Apply double adhesive tape 6 in the center of the cut out 7 and or 8. Do not remove final paper strip on double adhesive tape 6 until ready to position and place medallion on adhesive tape and shaped materials. Once the medallion is secured on adhesive tape, wrap the ribbon over the top of plaque-like member 1 and fold the ribbon so it fits into the cavity. Ribbon or neck-like material should be flat when folding over top of plaque-like member into the thin clearance cut on the top interior edge of the cavity 15. Align cover plate 2 with cavity 13, over the ribbon, and the counter bore rim on sides and bottom edge 14, placing the cover plate in counter bore recess. Fasten wood screws 3 into the plaque-like member; through the predrilled clearance holes on the cover plate 2 to secure the cover plate to plaque-like member. Tightening of screws 3 results in a flush tight fit of cover plate and plaque-like member with the ribbon concealed in cavity. Visually align and place one round soft material 4 in each corner on the backside of plaque-like member. Visually align and place engraved placard 5 on front side approximately one-third from bottom of the plaque-like member 1. The display for the medallion with a ribbon is ready for wall hanging mode. For standing mode, align table leg 17 into wall hanging notch 16 and pre-determined vertical groove 20 and slide table leg in an upward motion so as to tighten attachment hooks 19 into cavity and groove.

Although the invention has been described relative to specific materials and dimensions and placement, it is not limited and there are many variations and modifications thereof that will be readily apparent to those skilled in the art.

The main concept of placing the ribbon or necklace-like material in an enclosed cavity in the preferred embodiment is located on the backside of the plaque-like member under a cover plate. The location of the cavity and fastening means, and how the space for the ribbon is created can be supplemented in a variety of ways such as a space or cavity created in between materials that fit together by some method such as dowels, hinges or click-in parts illustrated in FIG. 8.

The plaque-like member and cavity 1 and the cover plate 2 presented in a standard size, may be produced in various sizes, and formed from other materials than just the wood like member described in the preferred embodiment herein. In the preferred embodiment, decorative wall plaque and cover plate is made of wood, such as pine, but could be made out of a quality wood such as oak, or walnut. Other materials might include suitable finished metal, plastic, plaster, glass, paper form, composite or cheaper wood having a veneer or other expensive appearing wood finishes. The color of the plaque-like member 1, if wood, could be stained different colors such as oak, cherry, and mahogany with or without a varnish or varathane coat.

The decorative material or materials 10 can be one or a combination of other materials such as felt, velvet, paper, plastic, aluminum etc. in a variety of colors and shapes to highlight the selected medallion and ribbon displayed.

The wooden screws could be replaced or supplemented with suitable nails, carpet tacks, hinges, or the like without departing from the spirit of the invention.

Other material such as foam or fasteners can be used inside cavity 13 to secure ribbon or necklace-like material in place.

Soft material placed in corners of backside of plaque 4 could be supplemented with screw on rubber bumpers, or in combination, so the plaque stands away from the wall when hung, or visually angles down for more visual appeal.

Other stand-alone table leg options to the preferred embodiment can be supplemented, such as a half size table leg with attachments 18. Or 21 as a swing out table leg attachment to cover plate, or easel like leg attachment not shown.

Information placement toward the bottom of front panel 12 can be done in various forms such as engraved lettering onto surface of plaque, or onto other material including, but not limited to polished brass, bright aluminum, acrylic opaque material label material, etc.

The selected medallion with ribbon can be various pendant type items with the ribbon or necklace-like material, for example, a ceramic pendant with leather as the necklace like material.

Numerous modifications and variations of the present invention are possible as described and illustrated without departing from the spirit or the scope of the invention. The objects set forth above, descriptions and drawings shown, shall be interpreted as illustrative and not in a limiting sense. It is therefore to be understood that, within the scope of the appended claims, the invention may be practiced otherwise than as specifically described herein.

We claim:

1. A display kit assembly for a medallion with ribbon comprising:

a plaque having peripheral edges on a front side thereof; at least one shaped panel attached to said front side, said at least one panel having a cut-out at a center thereof, and an adhesive means mounted in said cut-out for securing said medallion with ribbon to said plaque;

a cavity on a back side of the plaque that defines a space for the ribbon to be stored when said medallion with ribbon is attached to said plaque, wherein the cavity has a counter-bore defining a rim on at least three edges of said cavity, the rim having at least three corners, a cover plate that recesses into the counter-bore and rests on said rim to thereby become flush with the back side of the plaque, and a clearance cut on a top interior edge of the cavity providing a means for the ribbon to enter the cavity and become concealed under said cover plate; the cover plate includes a notched-out through-hole located in the middle-upper half thereof providing a means of hanging the assembly on a vertical surface, and means for fastening the cover plate to the plaque;

and a space provided toward the bottom edge of the front side of said plaque, below the medallion for displaying information about the medallion

2. The display kit assembly for a medallion with ribbon as claimed in claim 1, wherein the cavity has a depth that is significantly smaller than any of the dimensions of height or width of said plaque.

3. The display kit assembly for a medallion with ribbon as claimed in claim 1, further comprising:

a vertical guide groove located in a lower portion of said cover plate and in vertical alignment with said notched-out through-hole; a table leg attachment having two projections, wherein the projections are sized to fit within the vertical guide groove and the notched-out through-hole, respectively, to secure said table leg attachment to the back of said plaque, whereby said plaque can stand upright by leaning upon said table leg attachment.

* * * * *